US006934987B2

(12) United States Patent
Newkirk et al.

(10) Patent No.: US 6,934,987 B2
(45) Date of Patent: Aug. 30, 2005

(54) SURGICAL TABLE HAVING INTEGRAL LATERAL SUPPORTS

(75) Inventors: David C. Newkirk, Lawrenceburg, IN (US); Richard L Borders, Cincinnati, OH (US); Richard H. Heimbrock, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 214 days.

(21) Appl. No.: 10/095,593

(22) Filed: Mar. 11, 2002

(65) Prior Publication Data

US 2003/0167569 A1 Sep. 11, 2003

(51) Int. Cl.[7] ..... A61G 13/00; A61G 7/00

(52) U.S. Cl. ..... 5/613; 5/600; 5/607; 5/430; 5/618; 5/621

(58) Field of Search ..... 5/600, 607, 621, 5/613, 922, 430, 425, 618

(56) References Cited

U.S. PATENT DOCUMENTS

| | | | | | |
|---|---|---|---|---|---|
| 2,284,470 | A | * | 5/1942 | Comper et al. | 5/613 |
| 3,729,752 | A | * | 5/1973 | Huggins | 5/922 |
| 3,823,709 | A | | 7/1974 | McGuire | 5/621 |
| 3,844,550 | A | | 10/1974 | McGuire | |
| 3,938,205 | A | | 2/1976 | Spann | |
| 4,391,438 | A | | 7/1983 | Heffington, Jr. | |
| 4,702,465 | A | | 10/1987 | McConnell | |
| 4,717,133 | A | | 1/1988 | Walsh et al. | |
| 4,840,363 | A | | 6/1989 | McConnell | |
| 5,208,928 | A | * | 5/1993 | Kuck et al. | 5/621 |
| 5,239,716 | A | | 8/1993 | Fisk | 5/621 |
| 5,301,221 | A | | 4/1994 | Yakubisin | 378/181 |
| 5,390,383 | A | | 2/1995 | Carn | 5/624 |
| 5,444,882 | A | | 8/1995 | Andrews et al. | 5/618 |
| 5,500,964 | A | * | 3/1996 | Bergersen | 5/607 |
| 5,592,706 | A | * | 1/1997 | Pearce | 5/922 |
| 5,628,078 | A | | 5/1997 | Pennington et al. | 5/618 |
| 5,941,907 | A | | 8/1999 | Augustine | 607/104 |
| 6,032,309 | A | | 3/2000 | Michelson | 5/621 |
| 6,076,525 | A | | 6/2000 | Hoffman | 5/632 |
| D427,688 | S | | 7/2000 | Lab | |
| 6,298,507 | B1 | | 10/2001 | Clyburn | 5/623 |
| 6,311,349 | B1 | | 11/2001 | Kazakia et al. | 5/624 |
| 6,315,718 | B1 | | 11/2001 | Sharratt | 600/228 |
| 6,374,437 | B1 | * | 4/2002 | Voelker | 5/430 |
| 6,578,219 | B1 | * | 6/2003 | Gabel et al. | 5/600 |

OTHER PUBLICATIONS

O.R. Direct, Surgical Table Accessories, *Piece of Mind? Piece of Cake!, Great Products . . . Great Prices*, Fall 1999, 24 pages.

Allen Medical Systems, *Passionate About Positioning*, 1998, 20 pages.

* cited by examiner

*Primary Examiner*—Alexander Grosz
(74) *Attorney, Agent, or Firm*—Barnes & Thornburg

(57) ABSTRACT

A surgical table includes a patient support deck includes a central section and at least one side section movably coupled to the central section. The at least one side section is movable between a first position substantially coplanar with the central section and a second position extending upwardly relative to the central section to inhibit lateral movement of a patient lying on the patient support deck.

55 Claims, 18 Drawing Sheets

SURGICAL TABLE HAVING INTEGRAL LATERAL SUPPORTS

BACKGROUND AND SUMMARY OF THE INVENTION

This invention relates to surgical tables and more particularly to surgical tables having integral lateral supports.

Surgical tables on which patients are supported during surgery typically include accessory rails to which a wide variety of specialized patient-positioning equipment is attached. Such equipment is used to position and secure a patient's limbs or other body parts in a desired position during surgery. One such piece of patient-positioning equipment is a lateral brace or support that prevents the patient from shifting laterally or side-to-side on the surgical table. Not all of the various pieces of patient-positioning equipment are needed for every type of surgery and therefore, the various pieces of patient-positioning equipment typically are stored elsewhere in a hospital and are brought to an operating room, as needed, for attachment to the surgical table. It will be appreciated that storing the patient-positioning equipment at a remote location and moving the patient-positioning equipment around a hospital creates a risk that the equipment may be lost or damaged during transport. In addition, there is only a limited amount of space on the accessory rails of surgical tables for attachment of the patient-positioning equipment and any other medical equipment that attaches to the accessory rails.

According to this disclosure, one or more lateral supports are integrated into a patient support apparatus, such as a surgical table. Integration of the lateral supports into the patient support apparatus reduces the number of separate pieces of patient-positioning equipment that must be stored at a remote location and transported to the surgical site for attachment to the patient-support apparatus. In addition, integration of the lateral supports into the patient-support apparatus frees up space on accessory rails of the patient-support apparatus for other pieces of equipment.

According to the present disclosure, an illustrative surgical table includes a patient support deck having at least one patient support section. The at least one patient support section comprises a central portion and a side portion coupled to the central portion. The side portion is movable between a first position substantially coplanar with the central portion and a second position extending upwardly and longitudinally relative to the central portion to inhibit lateral movement of a patient lying on the patient support deck during a surgical procedure. Illustratively, the patient support deck includes head, back, seat and leg sections, and said at least one patient support section comprises the back section.

Illustratively, the at least one patient support section includes a pair of extended-length side portions movably coupled to the central portion on the opposite sides thereof. Another embodiment of the at least one patient support section includes a first pair of side portions movably coupled to the central portion on a first side of the central portion and a second pair of side portions movably coupled to the central portion on a second side of the central portion.

Illustratively, the side portion comprises a mattress pad, a mattress pad support panel and an elongated member coupled to the panel. According to the present disclosure, the mattress pad panel is pivotable relative to the elongated member about a first horizontal axis. Illustratively, the elongated member is pivotable about a second vertical axis when the side portion is in the second position extending upwardly relative to the central portion.

Additional features of the present invention will become apparent to those skilled in the art upon a consideration of the following detailed description of the following embodiments exemplifying the best mode of carrying out the invention as presently perceived.

BRIEF DESCRIPTION OF DRAWINGS

The detailed description particularly refers to the accompanying drawings in which.

DETAILED DESCRIPTION OF DRAWINGS

Figure 1:
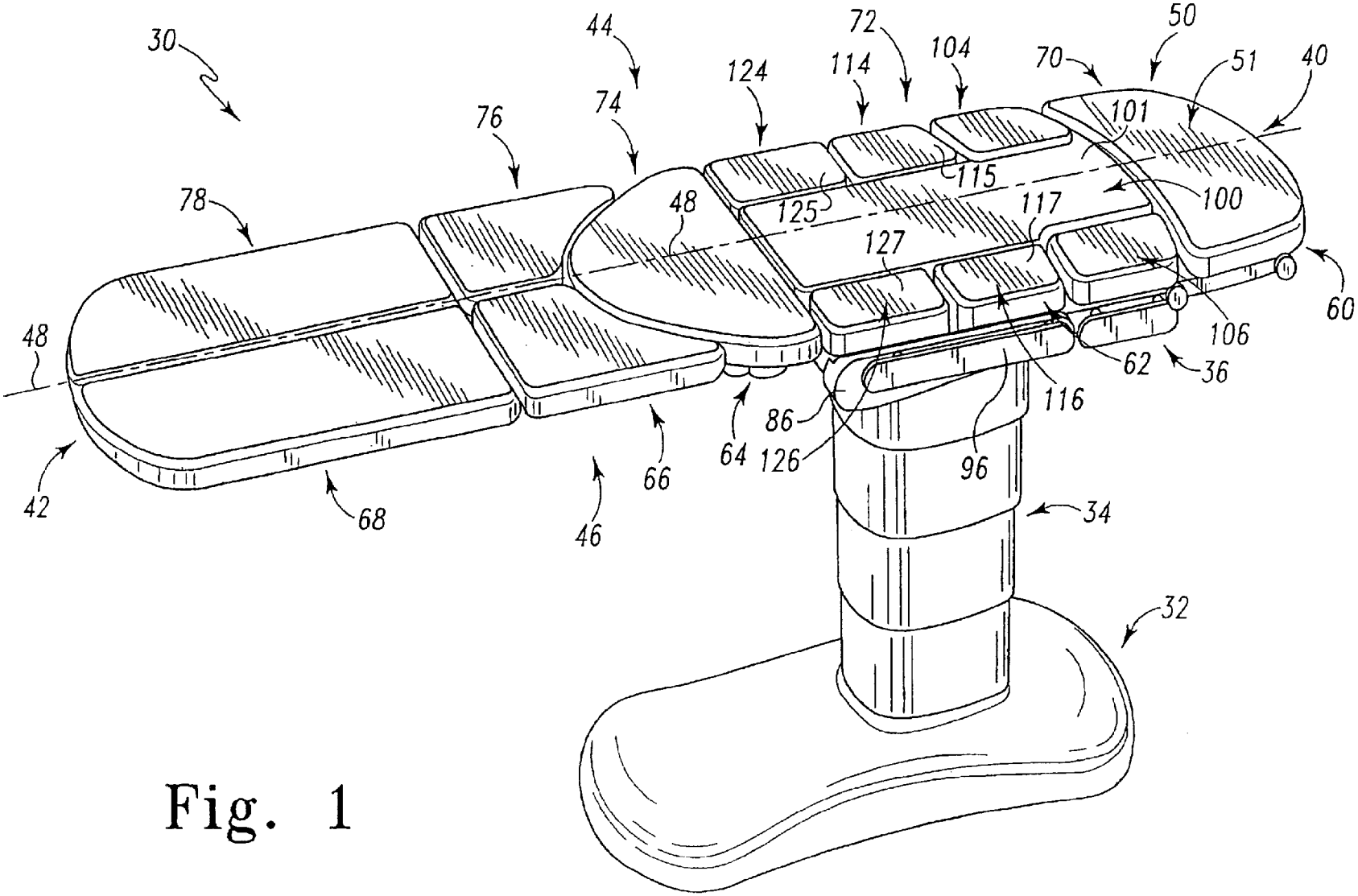
FIG. 1 is a perspective view of an illustrative surgical table including a base, a pedestal and a patient support deck having head, back, seat, thigh and leg sections, and showing the back section including a central portion, a first pair of side portions coupled to a first side of the central portion, and a second pair of side portions coupled to a second side of the central portion, the side portions being movable between a first position in which the side portions are substantially coplanar with the central portion and a second position in which the side portions face laterally inwardly toward a patient lying on the patient support deck.

A first embodiment of an illustrative surgical table 30 in accordance with the present disclosure is shown in FIG. 1. Although the specification of this application discusses the present disclosure in terms of a surgical table, the features of this invention have applicability to other patient supports such as operating tables, surgical stretchers, etc. The surgical table 30 includes a base 32, a pedestal 34 coupled to the base, and a patient support deck 36 (sometimes referred to as table top) coupled to the pedestal 34. The deck 36 has a head end 40, a foot end 42, first and second longitudinally-extending sides 44, 46 and a longitudinal axis 48. A mattress 50 supported on the deck 36 includes an upperwardly-facing patient support surface 51.

As used in this description, the phrase "head end 40" will be used to denote the end of any referred-to object that is positioned to lie nearest the head end 40 of the table 30, and the phrase "foot end 42" will be used to denote the end of any referred-to object that is positioned to lie nearest the foot end 42 of the table 30. Likewise, the phrase "first side 44" will be used to denote the side of any referred-to object that is positioned to lie nearest the first side 44 of the table 30, and the phrase "second side 46" will be used to denote the side of any referred-to object that is positioned to lie nearest the second side 46 of the table 30.

The pedestal 34 may include a lift mechanism (not shown) for moving the deck upwardly and downwardly relative to the base 32. Disclosure of a suitable lift mechanism is provided in a U.S. Provisional Patent Application, Ser. No. 60/264,214, entitled "Hydraulic Actuator Apparatus" and filed on Jan. 25, 2001, for Blyshak et al., the disclosure of which is expressly incorporated herein.

The deck 36 includes a plurality of longitudinally-spaced laterally-extending sections—namely, a head section 60, a back section 62, a seat section 64, a thigh section 66 and a leg section 68. The mattress 50 includes corresponding sections or pads—a head section 70, a back section 72, a seat section 74, a thigh section 76 and a leg section 78. The head, back, seat, thigh and leg sections 60–68 of the deck 36 generally correspond to the head, back, seat, thighs and legs of a patient positioned on the surgical table 30.

In the illustrative embodiment, the head section 60 is removably and pivotally coupled to the back section 62 near the head end 40 thereof. The seat section 64 is removably and pivotally coupled to the back section 62 near the foot end 42 thereof. The thigh section 66 is removably and pivotally coupled to the seat section 64. The leg section 68 is removably and pivotally coupled to the thigh section 66. The head, seat, thigh and leg sections 60, 64, 66, 68 can be pivoted to their desired positions and locked in place. Also, one or more of the head, seat, thigh and leg sections 60, 64, 66, 68 can be selectively removed to give the surgeon more flexibility and better access to the patient.

Figure 2:
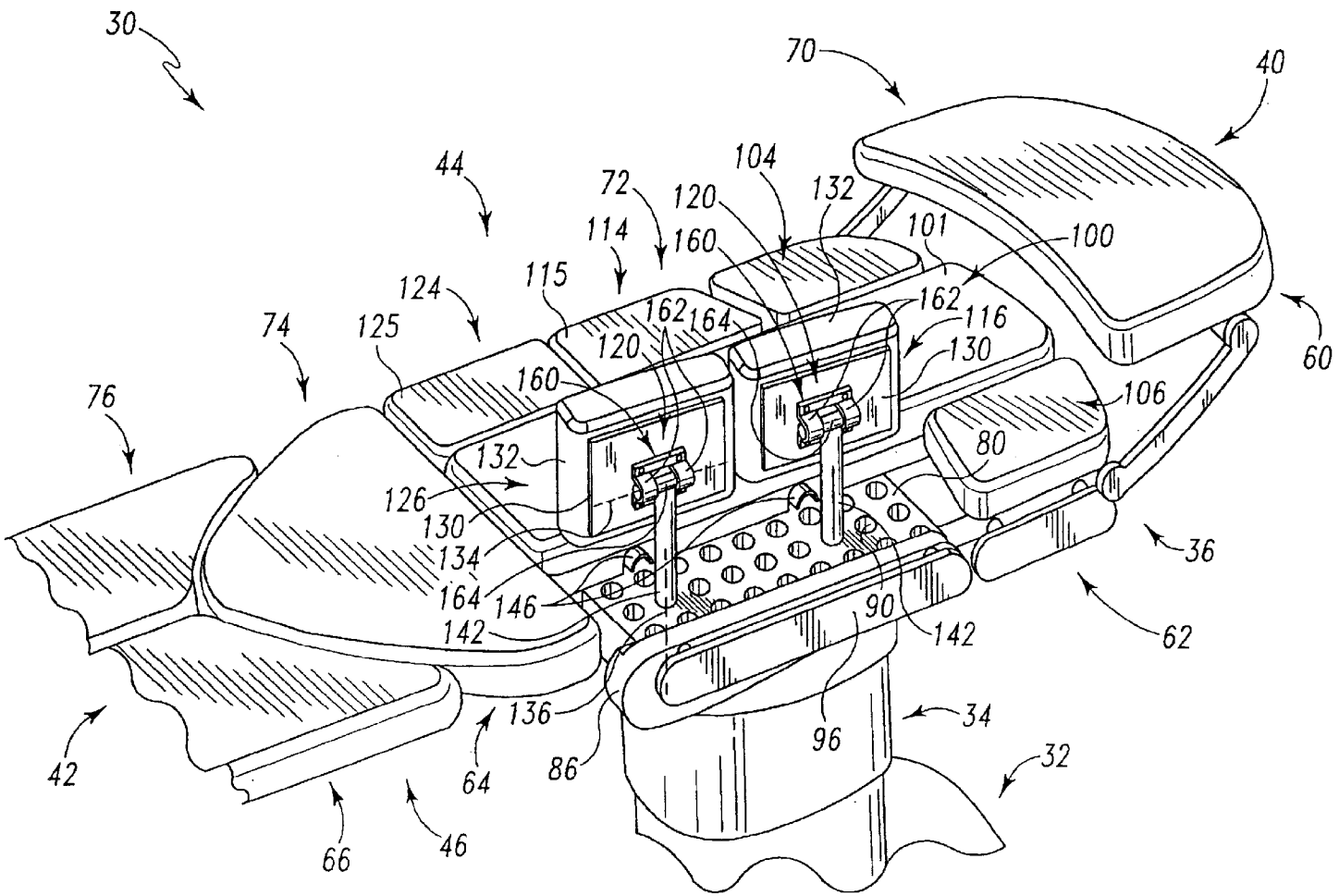
FIG. 2 is a partial perspective view of the illustrative surgical table, and showing the first pair of side portions disposed in the first coplanar position and the second pair of side portions moved to the second raised position, and showing a sub-panel underlying the deck and including a plurality of vertically-extending openings, each side portion including a mattress pad support panel coupled to an elongated member, and showing the elongated members of the second pair of side portions received in the vertically-extending openings to support the second pair of side portions in the second raised position.
Figure 3:
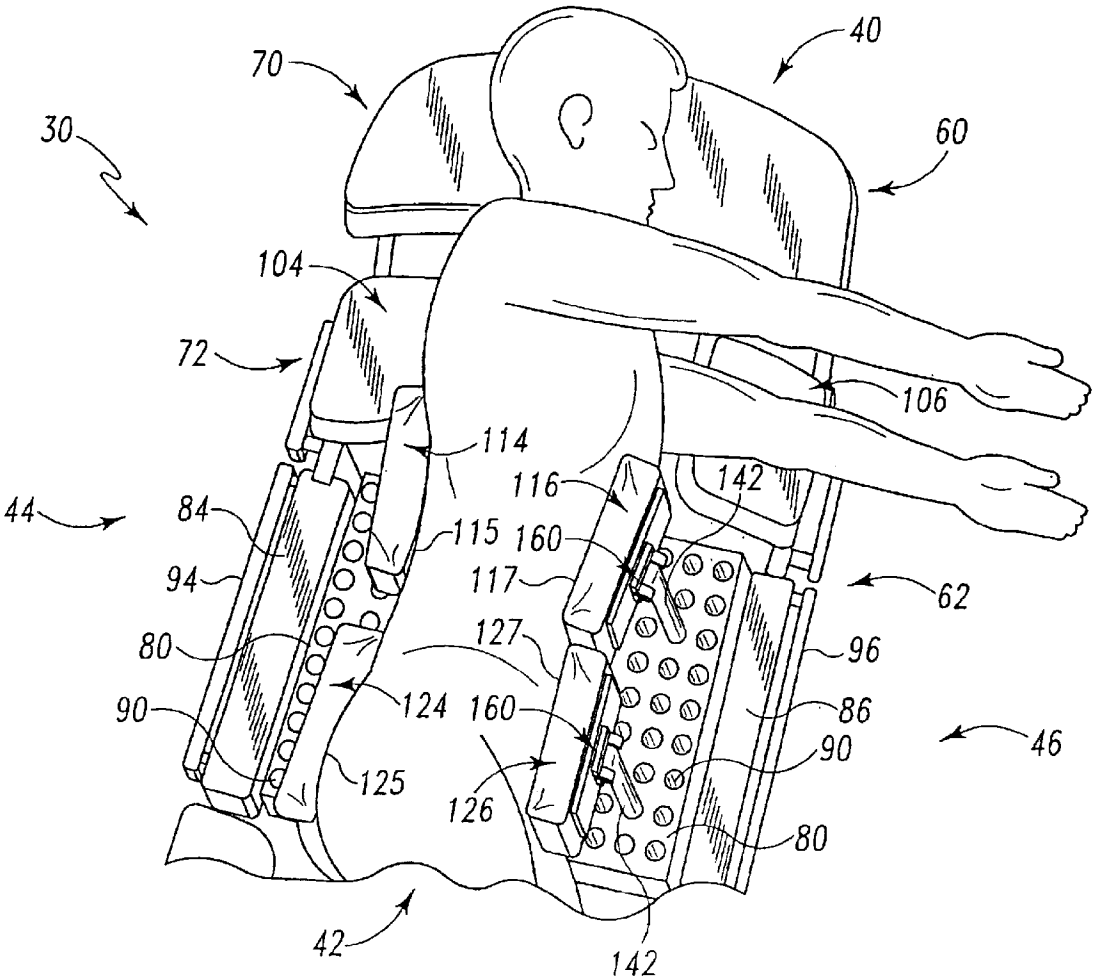
FIG. 3 is a partial perspective view of the illustrative surgical table, and showing a patient supported on the deck between the side portions, and the side portions facing laterally inwardly toward the patient lying on the deck and contacting the patient to inhibit the patient from moving laterally relative to the deck.
Figure 4:
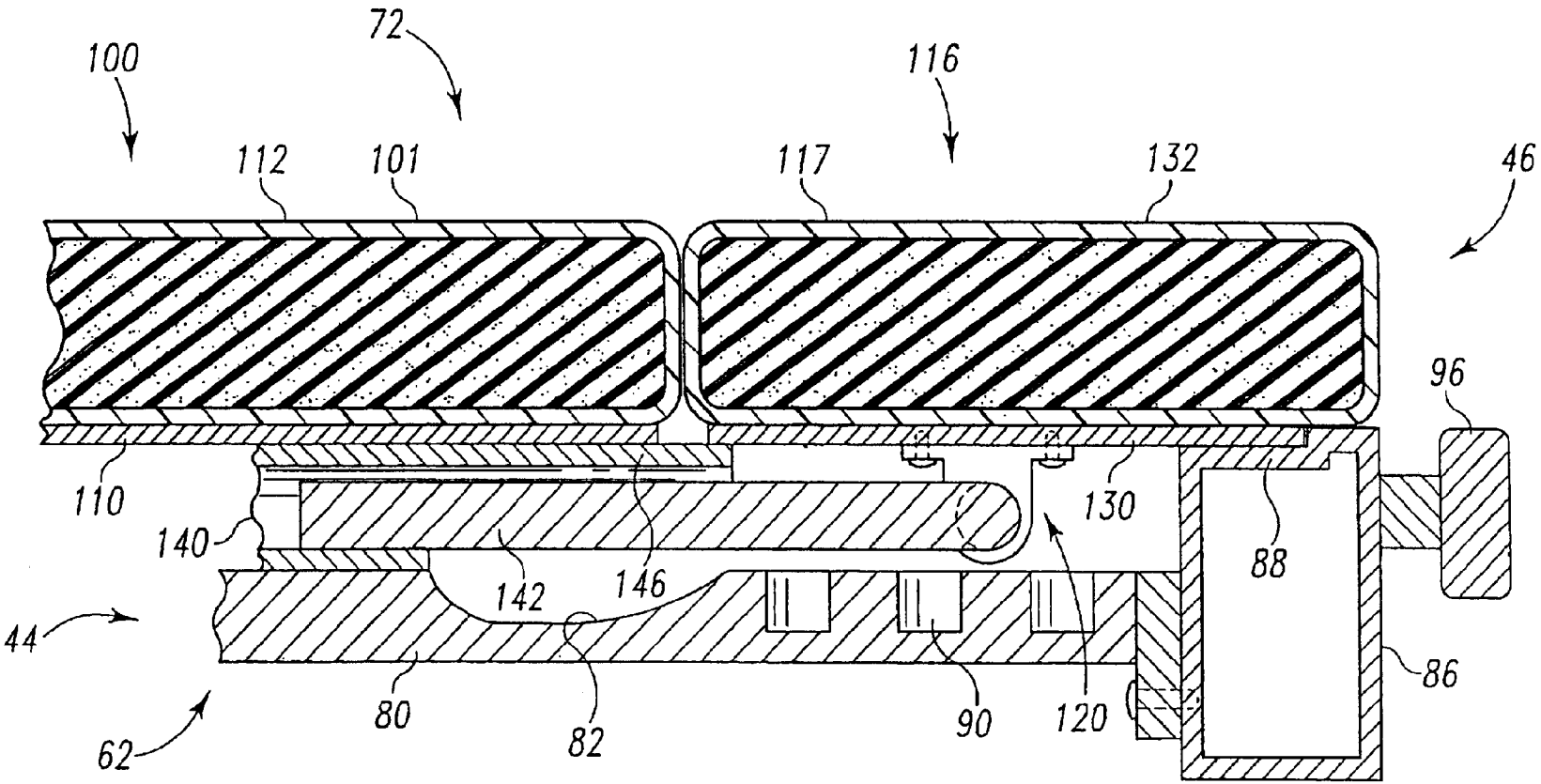
FIG. 4 is a cross sectional view of the illustrative surgical table along the line 4—4 in FIG. 3, and showing a generally horizontal transversely-extending socket tube underlying the central section and having an end portion extending beyond the central section, a longitudinally-extending frame member spaced apart from the central section, and showing the elongated member received in the socket tube and the mattress pad support panel resting upon both the frame member and the end portion of the socket tube when the side portion is in the first coplanar position.

As shown in FIGS. 2–4, the deck 36 includes a sub-panel 80 underlying the back section 62 and a pair of laterally-spaced longitudinally-extending frame members 84, 86 attached to the opposite sides 44, 46 of the sub-panel 80. The sub-panel 80 includes a plurality of generally vertically-extending openings 90 arranged in a grid form. A pair of accessory rails 94, 96 are attached on the opposite sides 44, 46 of the deck 36 to the respective frame members 84, 86. The accessory rails 94, 96 are used to support a wide variety of accessories useful during surgery.

The back section 62 includes a central portion 100, a pair of shoulder pads 104, 106 coupled to the opposite sides 44, 46 of the central portion 100, a first pair of side portions 114, 124 coupled to the first side 44 of the central portion 100, and a second pair of side portions 116, 126 coupled to the second side 46 of the central portion 100. Each side portion 114, 124, 116, 126 (also referred to as lateral portion) is movably coupled to the central portion 100 by a coupler 120.

Each side portion 114, 124, 116, 126 is configured to move between a first position shown in FIG. 1 and a second position shown in FIG. 3. In the first position shown in FIG. 1, the upper surfaces 115, 125, 117, 127 of the side portions 114, 124, 116, 126 are substantially coplanar with upper surface 101 of the central portion 100. In the second position shown in FIG. 3, the side portions 114, 124, 116, 126 extend generally longitudinally and upwardly relative to the central section 100, so that the upper surfaces 115, 125, 117, 127 of the side portions 114, 124, 116, 126 face laterally inwardly toward a patient lying on the deck 36 to inhibit lateral movement of the patient.

Referring to FIGS. 2–7, the central portion 100 includes a central panel 110 and a mattress pad 112 coupled to the central panel 110. Likewise, each side portion 114, 116, 124, 126 includes a side panel 130 and a mattress pad 132 coupled to the side panel 130. Preferably, the mattress pads 112, 132 are releasably coupled to the respective panels 110, 130. Any suitable fastener, such as a hook-and-loop type fastener, may be used to releasably attach the mattress pads 112, 132 to the respective panels 110, 130 so that the mattress pads can be readily attached to or detached from the panels—for example, for repair or cleaning.

Each coupler 120 includes a generally horizontal transversely-extending socket tube 140 located under the central panel 110 and an elongated arm 142 pivotally coupled to the side panel 130 and configured to be movable within the tube 140. The elongated arm 142 is rotatable relative to the side panel 130 about a generally horizontal longitudinally-extending axis 134 as shown in FIG. 2. There are a total of four tubes 140 underlying the central panel 110—two tubes 140 on each side 44, 46 of the central panel 110. First and second end portions 144, 146 of each socket tube 140 extend outwardly from beneath the central panel 110 on the first and second sides 44, 46 toward the respective frame members 84, 86. The upper surfaces of the frame members 84, 86 are formed to include recessed seat portions 88. When the side portions 114, 124, 116, 126 are in the first coplanar position as shown in FIG. 4, the elongated arms 142 are received in the respective socket tubes 140 and the side panels 130 rest on both the end portions 144, 146 of the socket tubes 140 and the recessed seat portions 88 in the frame members 84, 86. Reception of the outer portions of the side panels 130 in the recessed seat portions 88 in the frame members 84, 86 prevents the side panels 130 from accidently sliding out—for example, when the deck 36 is tilted about its longitudinal axis 48.

Figure 5:
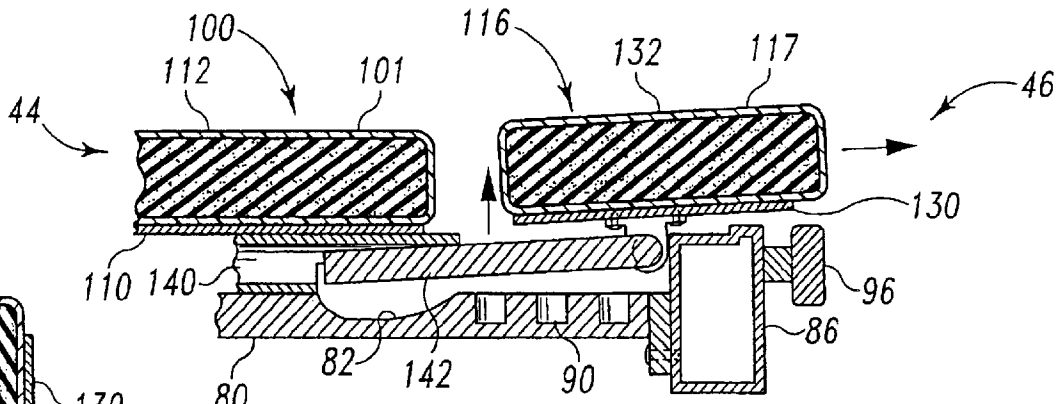
FIGS. 5-7 are cross sectional views similar to FIG. 4, and showing the elongated member being slid out of the transversely-extending socket tube and inserted into a vertically-extending opening in the sub-panel underlying the central portion to support the side portion in the second raised position extending generally longitudinally and upwardly relative to the central portion.
Figure 7:
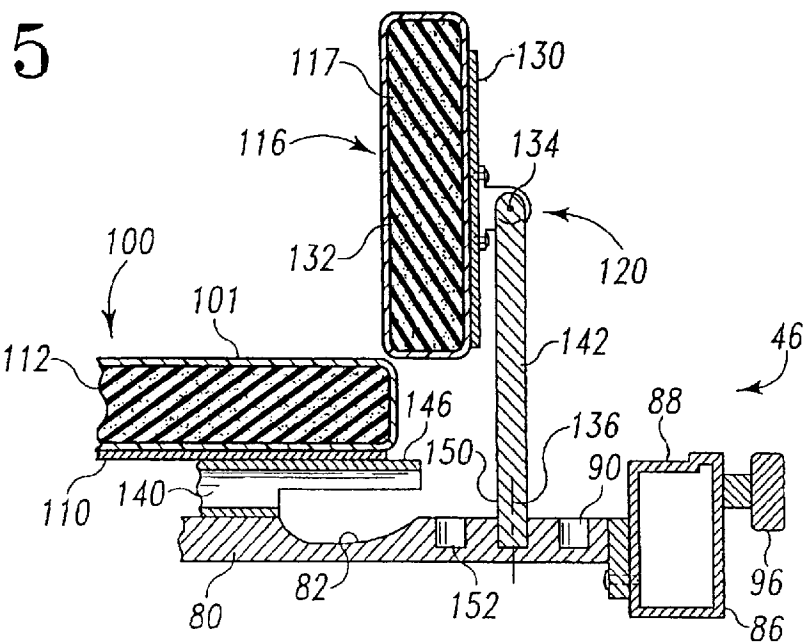
Figure 6:
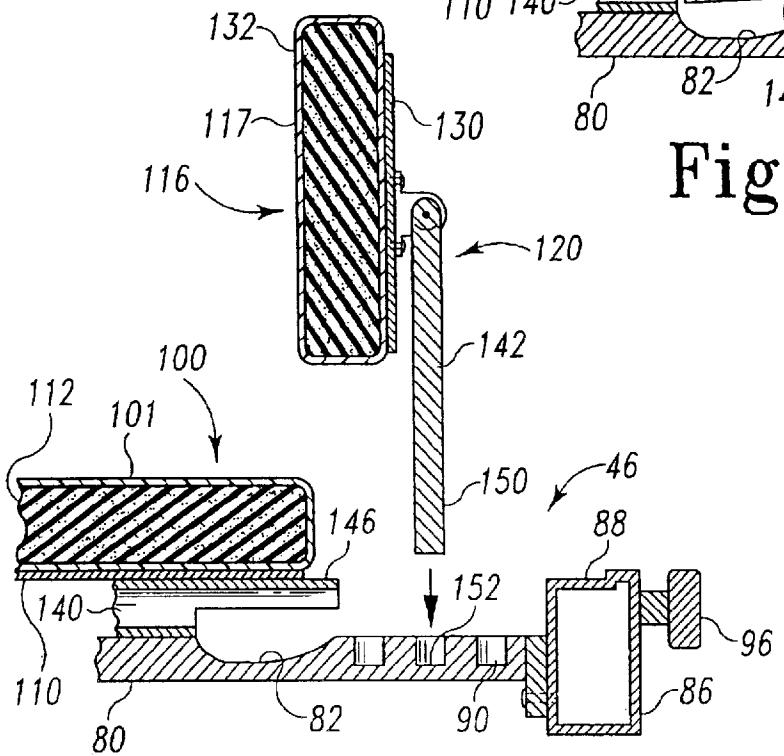

As shown in FIGS. 5–7, the elongated arms 142 are configured to be slid out of the horizontally-extending socket tubes 140 and inserted into the respective vertically-extending openings 90 in the sub-panel 80 to support the side portions 114, 124, 116, 126 in the second raised positions. As shown in FIG. 2, each elongated arm 142 is pivotable relative to the sub-panel 80 about a generally vertically-extending axis 136 when the side portions 114, 116, 124, 126 are in their respective raised positions. As shown in FIG. 5, notches 82 (also referred to as troughs) are provided in the sub-panel 80 adjacent to the free ends 144, 146 of the socket tubes 140 to provide room for pivoting the elongated arms 142 as the elongated arms 142 are extracted from the respective socket tubes 140.

Figure 8:
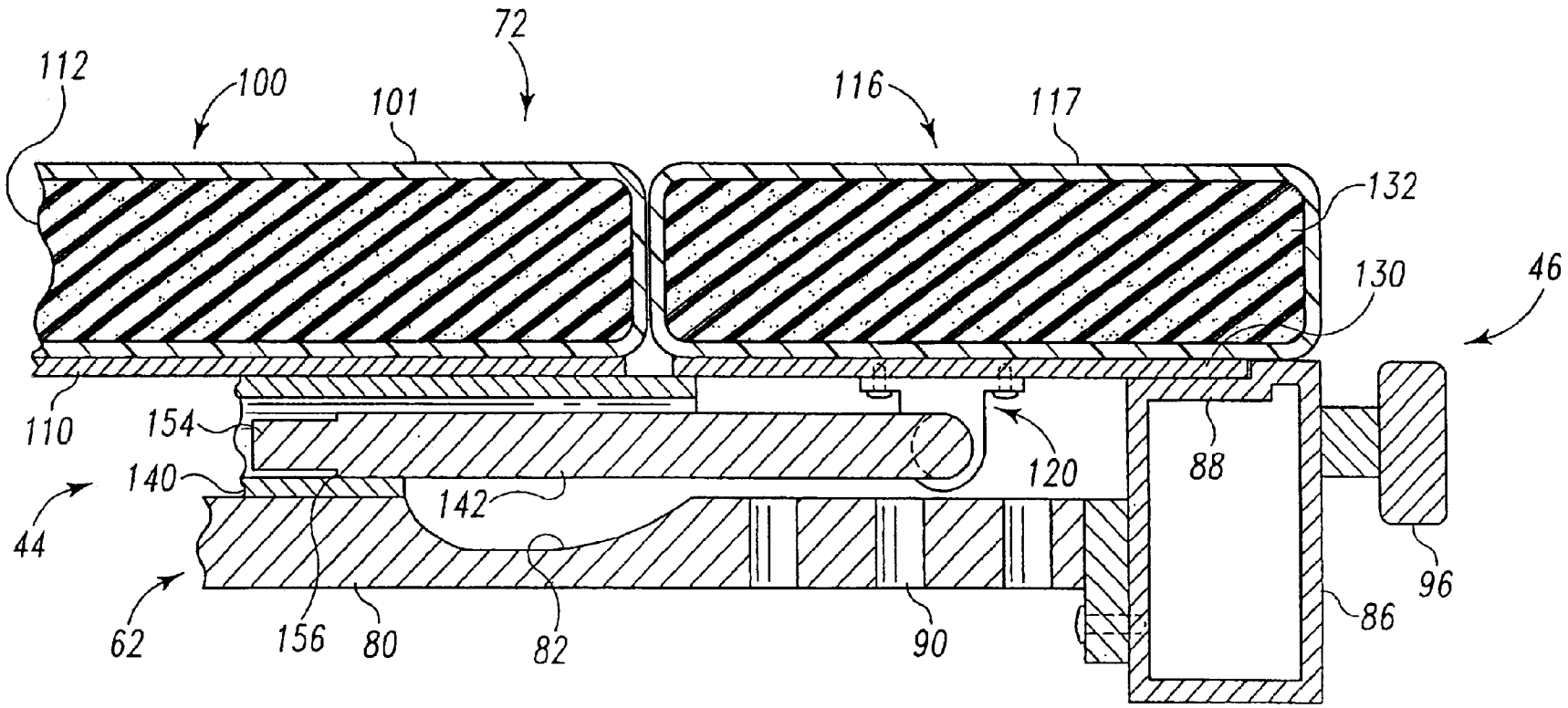
FIG. 8 is a cross sectional view similar to FIG. 4, and showing the openings in the sub-panel extending through the sub-panel, and the free end of the elongated member having a stepped portion.
Figure 9:
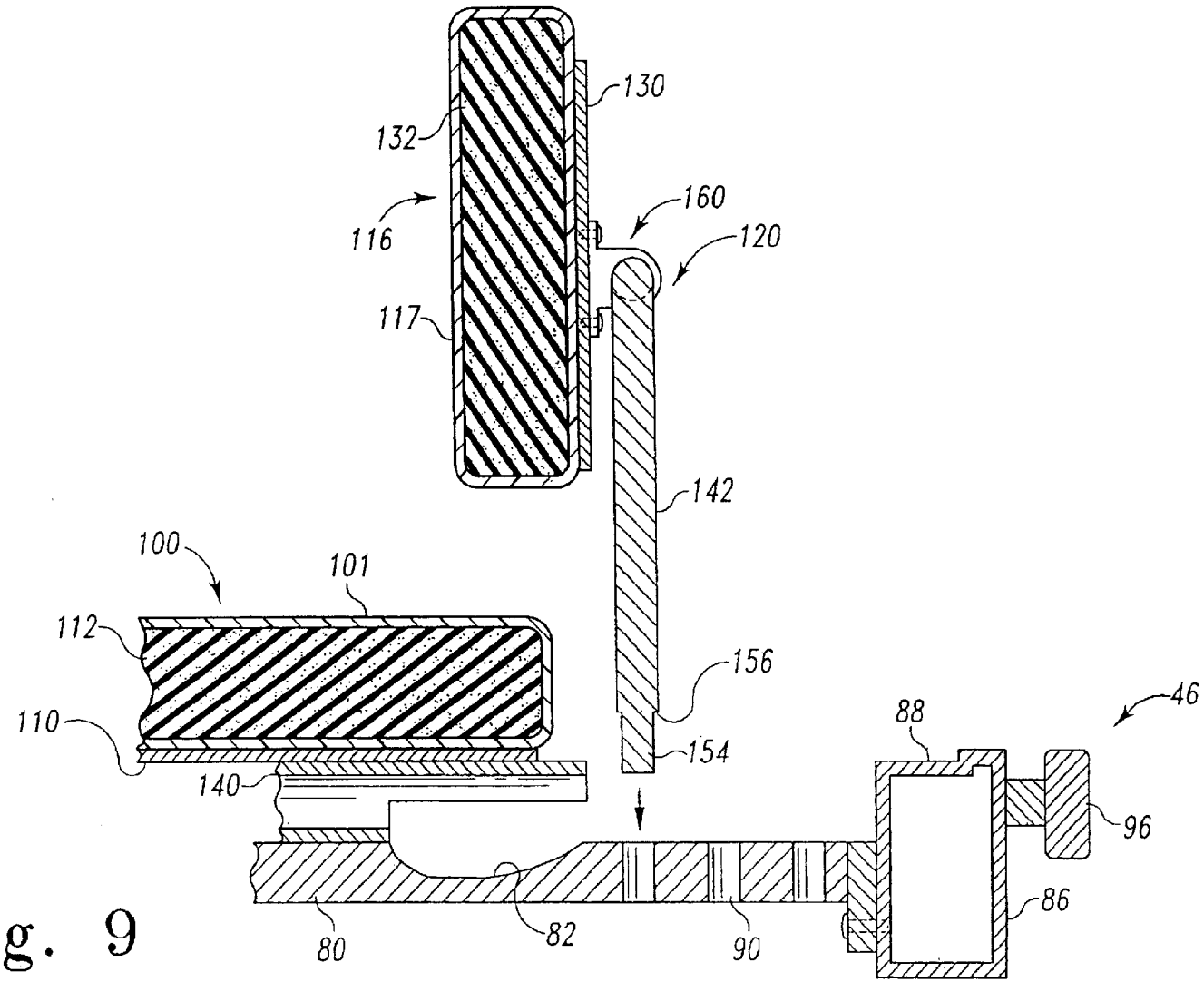
FIG. 9 is a cross sectional view similar to FIG. 6, and showing the stepped portion of the elongated member aligned with a vertically-extending through opening in the sub-panel.

In the embodiment shown in FIGS. 4–7, the vertically-extending openings 90 in the sub-panel 80 are blind. In this embodiment, the free ends 150 of the elongated arms 142 rest on floors 152 formed in the sub-panel 80 as shown in FIG. 7. In the embodiment shown in FIGS. 8 and 9, however, the vertically-extending openings 90 extend through the sub-panel 80. In this embodiment, the reduced-diameter free ends 154 of the elongated arms 142 are configured to form annular seat portions 156 for supporting the elongated arms 142. As previously indicated, the vertically-extending openings 90 in the sub-panel 80 are preferably arranged in a grid form as rows and columns, and are generally located outside the footprint of the central portion 100. Illustratively, the sub-panel 80 includes 3 rows of 9 openings 90 each. The grid configuration of the openings 90 allows the side portions 114, 116, 124, 126 to be redeployed or repositioned to accommodate patients of different size.

A pivot joint 160 couples each side panel 130 to its elongated arm 142 for rotation about the horizontal axis 134. Also, each elongated arm 142 is pivotable about the vertical axis 136. This allows the side panels 130 to pivot about two mutually perpendicular axes 134, 136 to improve the fit of the side portions 114, 124, 116, 126 to the patient lying on the deck 36. Illustratively, each pivot joint 160 includes a pair of longitudinally-spaced bushings 162 coupled to the underside of the side panel 130 and a pivot pin 164 attached to the elongated arm 142 and rotatably received in the bushings 162.

Referring to FIGS. 10–15, another embodiment 230 of the present invention is shown in which like elements generally bear the same reference numerals as in the first embodiment of FIGS. 1–9, except that they are preceded by a numeral "2". Thus, the surgical table 230 includes a base 232, a pedestal 234, a deck 236 and a mattress 250. The deck 236 includes a head section 260, a back section 262, a seat section 264, a thigh section 266 and a leg section 268. The mattress 250 includes a head section 270, a back section 272, a seat section 274, a thigh section 276 and a leg section 278. The deck 236 includes a pair of longitudinally-spaced transversely-extending cross members 280, 282 underlying the back section 262 and a pair of laterally-spaced longitudinally-extending frame members 284, 286 attached to the opposite sides 244, 246 of the cross members 280, 282. A pair of accessory rails 294, 296 are attached to the respective frame members 284, 286.

The back section 262 includes a central portion 2100, an upper back support portion 2102, a pair of shoulder pads 2104, 2106, a first extended-length side portion 2114 coupled to the first side 244 of the central portion 2100 and a second extended-length side portion 2116 coupled to the second side 244 of the central portion 2100. A first coupler 2124 movably couples the first side portion 2114 to the central portion 2100 on the first side 244. A second coupler 2126 movably couples the second side portion 2116 to the central portion 2100 on the second side 246. Each side portion 2114, 2116 is configured to move between a first position shown in FIGS. 10 and 14, and a second position shown in FIGS. 12, 13 and 15. In the first position shown in FIGS. 10 and 14, the upper surfaces 2115, 2117 of the side portions 2114, 2116 are substantially coplanar with upper surface 2101 of the central portion 2100. In the second position shown in FIGS. 12, 13 and 15, the side portions 2114, 2116 extend generally longitudinally and upwardly relative to the central section 2100, so that the upper surfaces 2115, 2117 of the side portions 2114, 2116 face laterally inwardly toward a patient lying on the deck 236 to prevent the patient from moving laterally outwardly off the central portion 2100.

The central portion 2100 includes a central panel 2110 and a mattress pad 2112 coupled to the central panel 2110. Likewise, each side portion 2114, 2116 includes a side panel 2130 and a mattress pad 2132 coupled to the side panel 2130. Preferably, the mattress pads 2112, 2132 are releasably coupled to the respective panels 2110, 2130. The central panel 2110 is supported on the transversely-extending cross members 280, 282 by four posts 2118. The central panel 2110 has end portions 2134, 2136 that extend outwardly beyond the mattress pad 2112 toward the respective frame members 284, 286. When the side portions 2114, 2116 are in the first coplanar position shown in FIGS. 10 and 14, the side panels 2130 rest upon both the frame members 284, 286 and the end portions 2134, 2136 of the central panel 2110.

Figure 12:
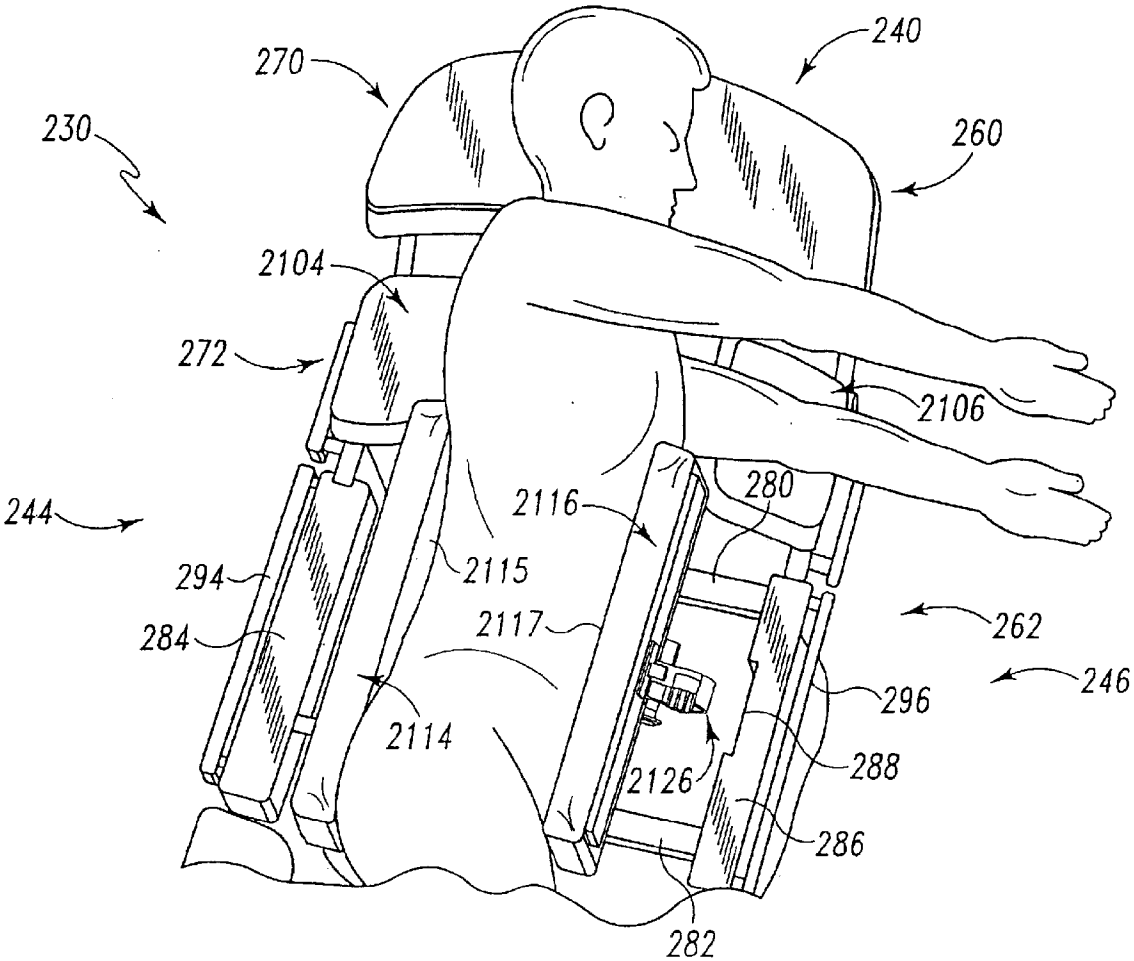
FIG. 12 is a partial perspective view similar to FIG. 3 of the FIG. 10 surgical table, and showing a patient supported on the deck between the two extended-length side portions, and the side portions facing laterally inwardly toward the patient lying on the deck and contacting the patient to inhibit the patient from moving laterally.
Figure 13:
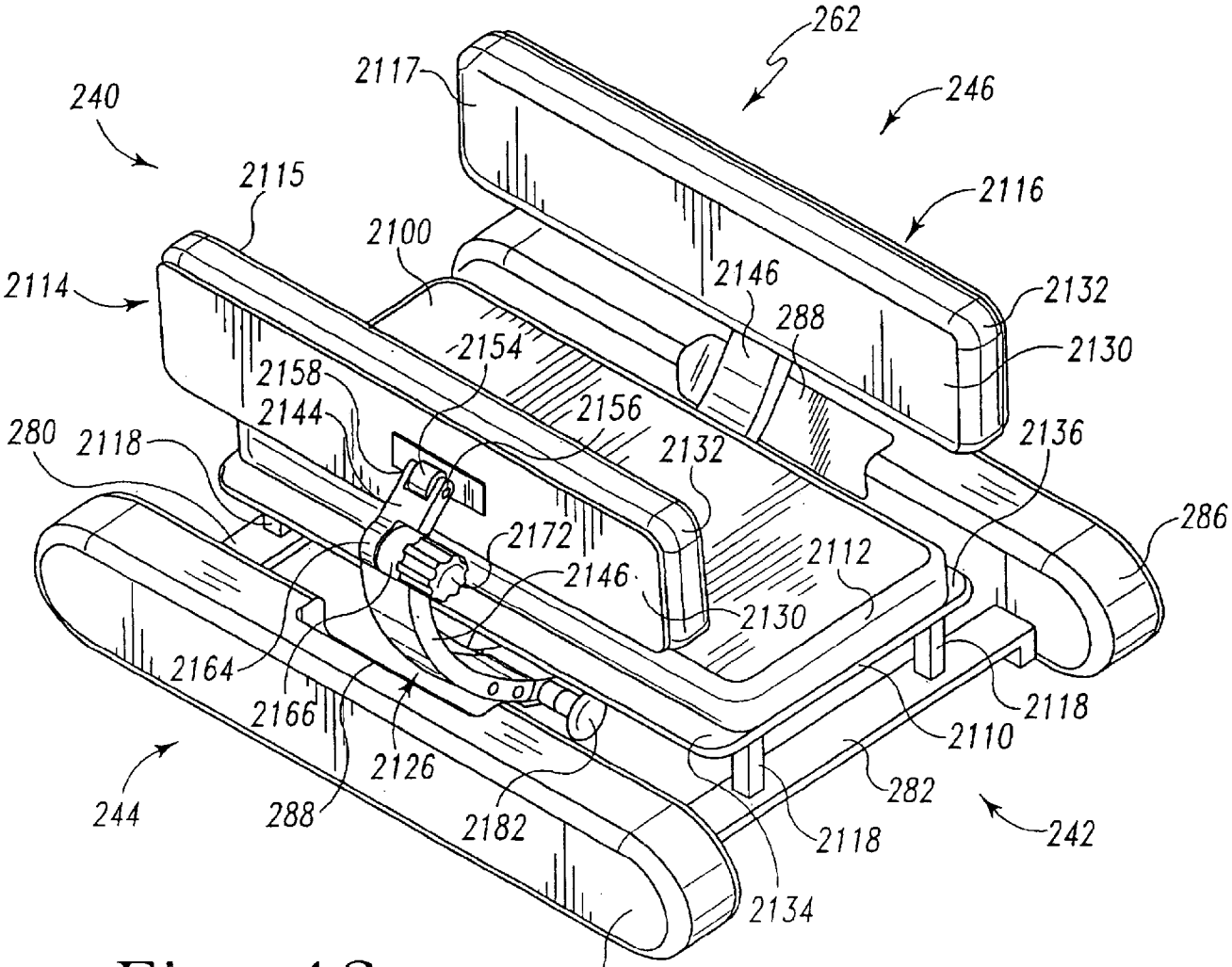
FIG. 13 is a partial perspective view of the FIG. 10 surgical table, broken away to show a curved telescoping mechanism coupling the side portions to the central portion for movement between a first coplanar position and a second raised position.
Figure 14:
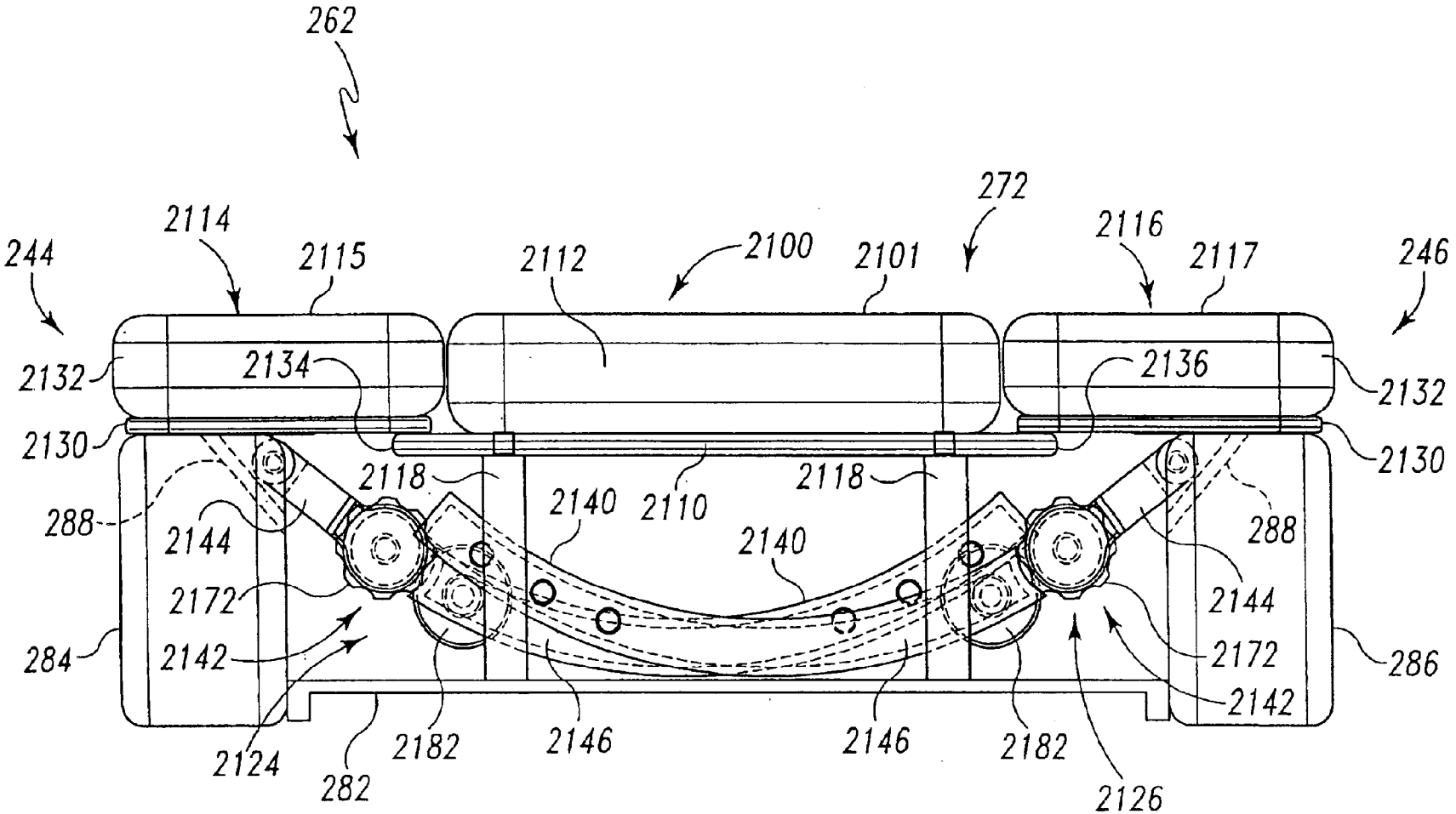
FIG. 14 is an end view of the FIG. 13 curved telescoping mechanism, and showing the side portions in the first coplanar position.
Figure 15:
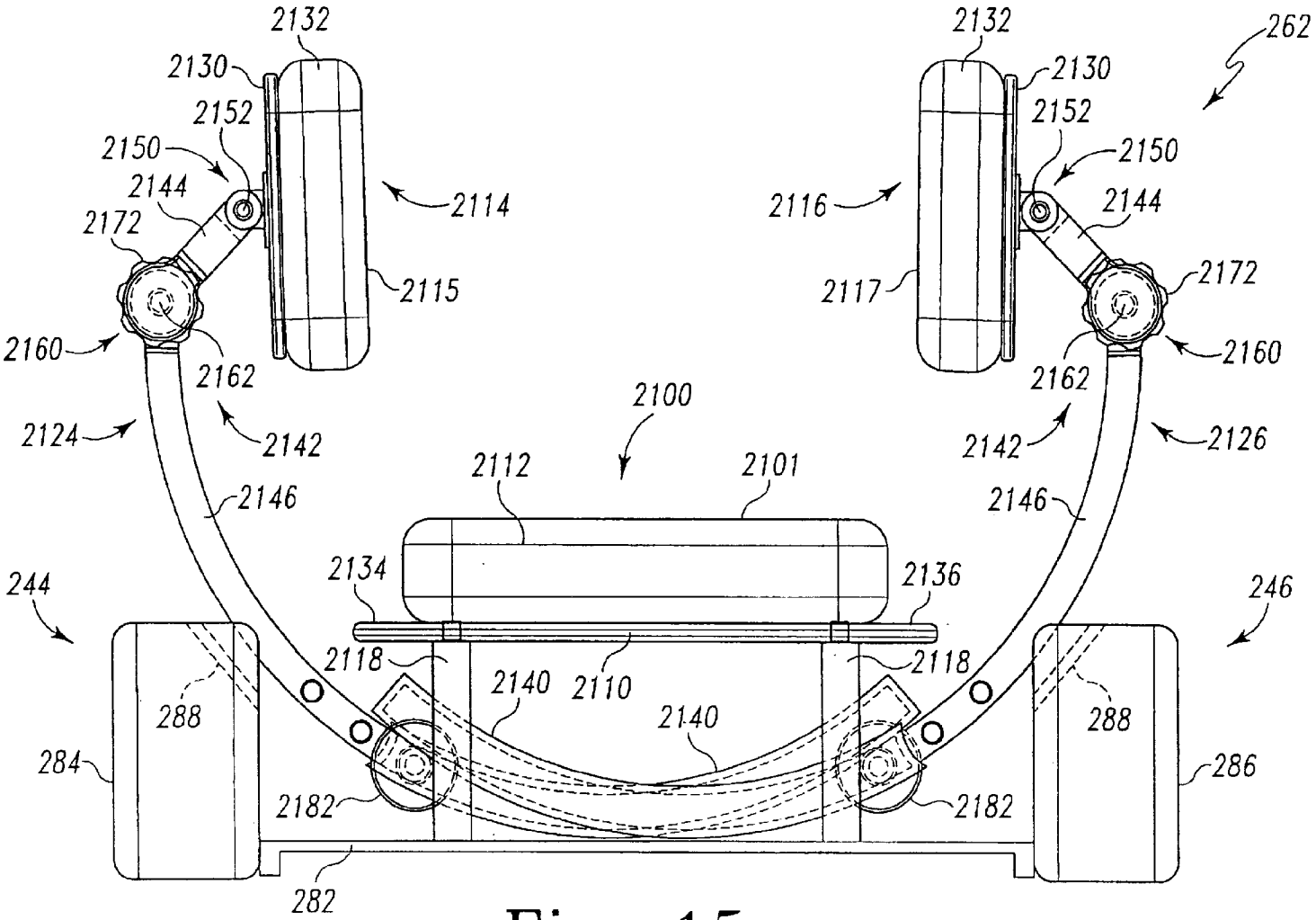
FIG. 15 is an end view similar to FIG. 13, and showing the side portions in the second raised position.

Referring to FIGS. 13–15, each coupler 2124, 2126 includes a transversely-extending socket tube 2140 underlying the central panel 2110 and an arm assembly 2142 having a first arm 2144 coupled to the side panel 2130 and a second arm 2146 coupled to the first arm 2144 and configured to be movable within the tube 2140. As shown in FIGS. 14 and 15, the socket tube 2140 and the second arm 2146 are both curved about a generally horizontal longitudinally-extending axis. The first arm 2144 is relatively short, and the second arm 2144 is relatively long. The second arm 2146 extends from the first arm 2144 into the tube 2140. The second arm 2146 is movable within the tube 2140 to move the side panel 2130 between the first coplanar position shown in FIGS. 10 and 14 and the second raised position shown in FIGS. 12, 13 and 15. Illustratively, the second arm 2146 and the bore in the tube 2140 in which the second arm 2146 is received both have a rectangular cross section.

As shown in FIG. 15, each coupler 2124, 2126 includes a first pivot joint 2150 configured to pivotally couple the side panel 2130 to the first arm 2144 for rotation about a first pivot axis 2152. In addition, each coupler 2124, 2126 includes a second pivot joint 2160 configured to pivotally couple the first arm 2144 to the second arm 2146 for rotation about a second pivot axis 2162. Both pivot axes 2152, 2162 extend substantially parallel to each other and parallel to the longitudinal axis 248 of the deck 236. Referring to FIGS. 13–15, the first pivot joint 2150 includes a bushing 2154 coupled to the underside of the side panel 2130 and a pivot pin 2156 coupled to a forked end 2158 of the first arm 2144 and rotatably received in the bushing 2154. The opening in the bushing 2154 is sized to form a snug friction fit with the pivot pin 2156 to allow rotation of the side panel 2130 about the first pivot axis 2152.

The second pivot joint 2160 includes a bushing 2164 coupled to the first arm 2144, a bushing 2166 coupled to the second arm 2146 and a pivot pin 2168 (not shown) extending through the two bushings 2164, 2166. The holes in the bushings 2164, 2166 are slightly oversized to permit rotation of the pivot pin 2168. A washer (not shown) is appended to a first end of the pivot pin 2168 and a knob 2172 is appended to a second end of the pivot pin 2168. The mating surfaces of the bushing 2166 and the knob 2172 are cammed. The rotation of the knob 2172 in a clockwise direction draws the two bushings 2164, 2166 together to lock the first arm 2144 relative to the second arm 2146. On the other hand, the rotation of the knob 2172 in an anticlockwise direction permits the two bushings 2164, 2166 to move apart to free the first arm 2144 to rotate about the second arm 2146. Thus, the knob 2172 is rotatable to a locking position to prevent the first arm 2144 from pivoting relative to the second arm 2146, and the knob 2172 is rotatable to a releasing position to permit the first arm 2144 to pivot relative to the second arm 2146. The external surface of the knob 2172 may be textured or knurled to provide improved grip.

Figure 10:
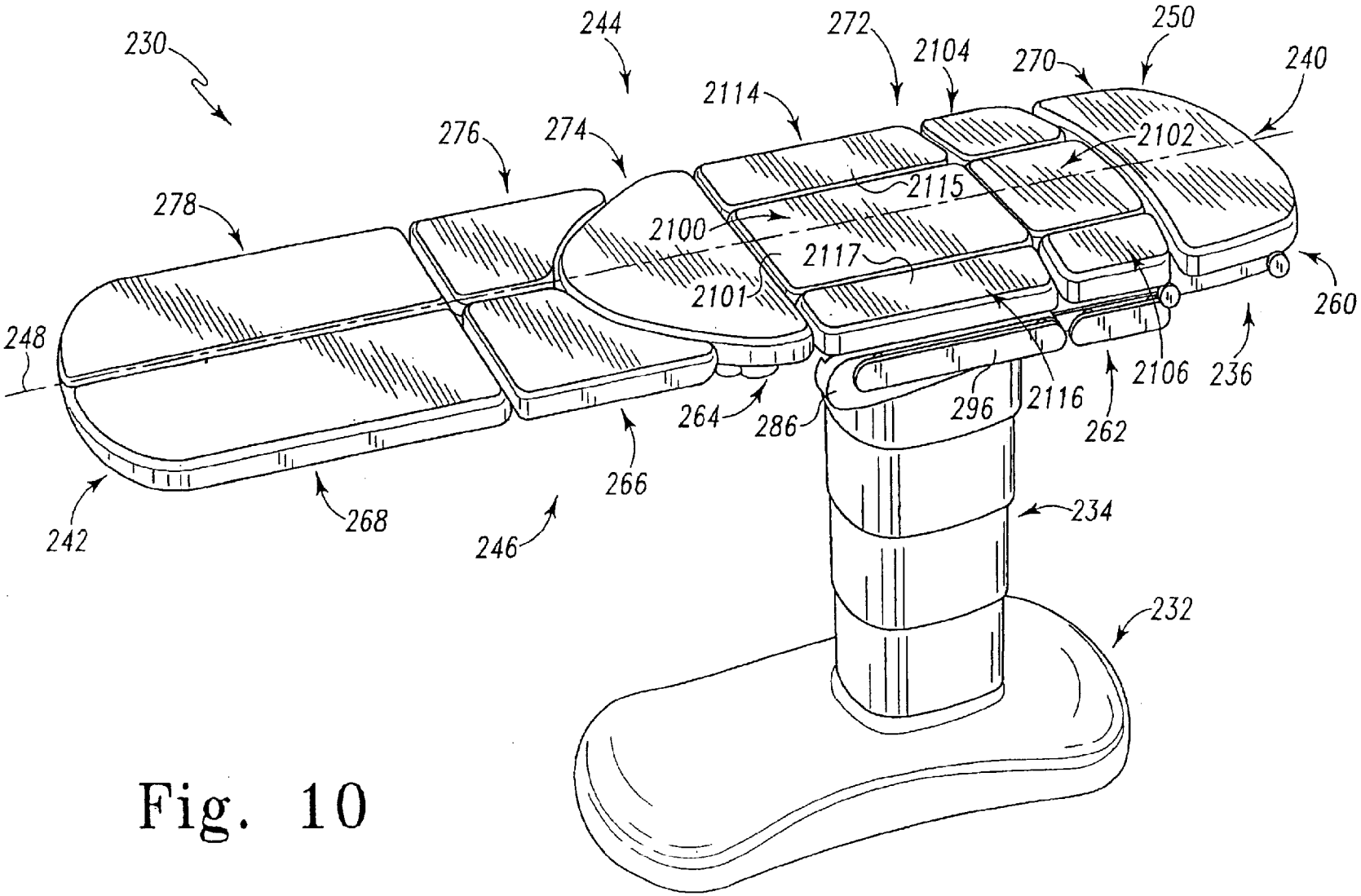
FIG. 10 is a perspective view similar to FIG. 1 of another embodiment of the illustrative surgical table, and showing the back section including a central portion, a first extended-length side portion coupled to the central portion on the first side thereof, a second extended-length side portion coupled to the central portion on the second side thereof, the side portions being movable between a first position in which the side portions are substantially coplanar with the central portion and a second position in which the side portions are extending generally longitudinally and upwardly relative to the central portion.
Figure 11:
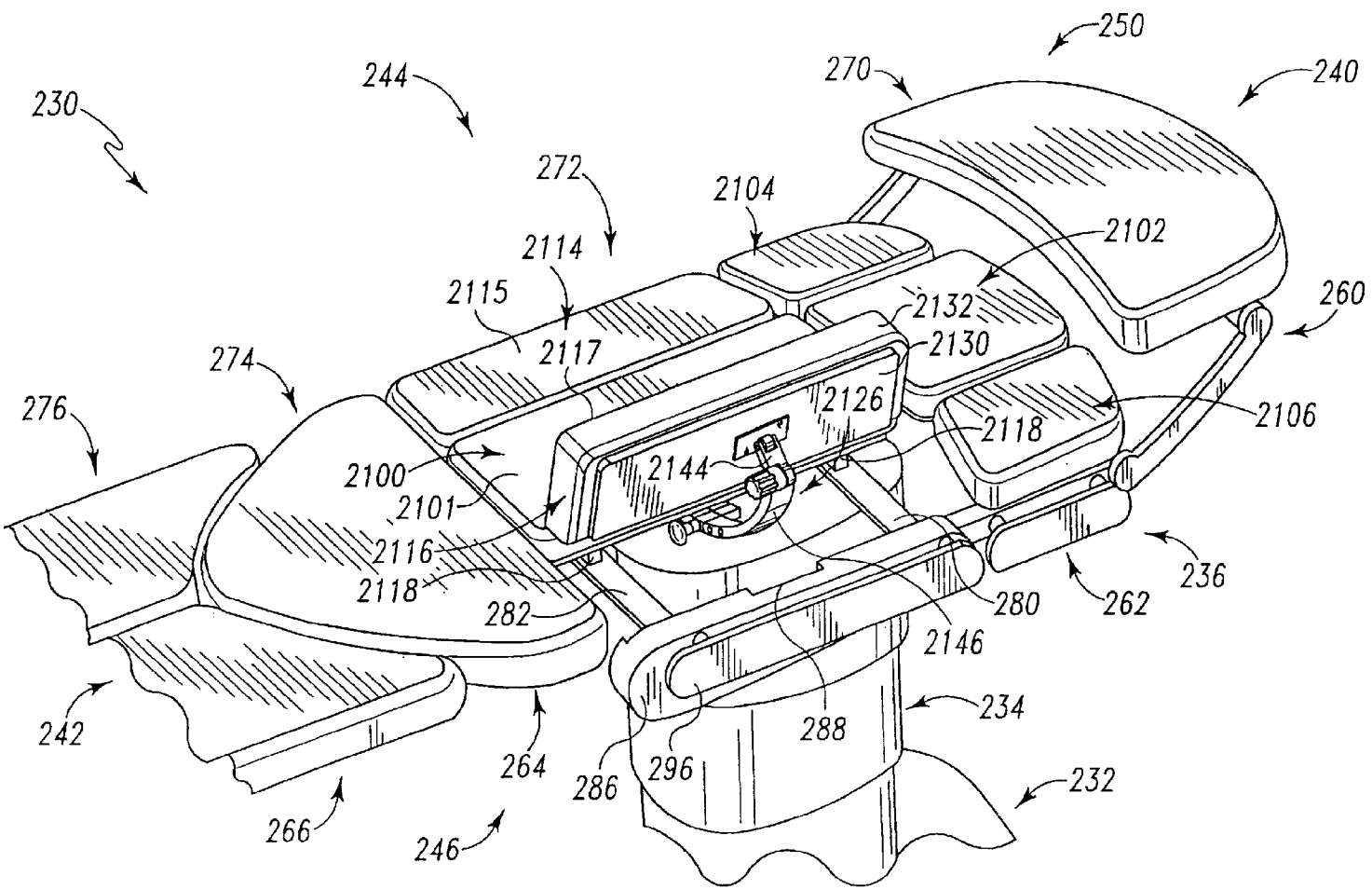
FIG. 11 is a partial perspective view similar to FIG. 2 of the FIG. 10 surgical table, showing the first extended-length side portion disposed in the first coplanar position, and showing the second extended-length side portion pivoted upwardly to the second raised position.

As shown in FIGS. 11–15, cutouts 288 are provided in the upper surfaces of the frame members 284, 286 to allow the curved arms 2146 to move between the first coplanar position shown in FIGS. 10 and 14, and the second raised position shown in FIGS. 12, 13 and 15. Each coupler 2124, 2126 includes a pull pin 2182 having a knob, and coupled to the respective socket tube 2140. The free end of the pull pin 2182 is configured to be received in one of a plurality of laterally-spaced longitudinally-extending apertures in the curved second arm 2146. When the pull pin 2182 is received in one of the apertures, the curved second arm 2146 is prevented from moving relative to the socket tube 2140. The pull pin 2182 is spring biased to the locking position. To free the second arm 2146, the pull pin 2182 is pulled out of the aperture in the second arm 2146. The pull pins 2182 are not received in any of the apertures when the side portions 2114, 2116 are in their coplanar positions shown in FIGS. 10 and 14. This allows the side portions 2114, 2116 to be manually moved to their vertical positions. The pull pins 2182 snap into the first apertures that become aligned with the pull pins 2182 as the side portions 2114, 2116 are moved to their vertical positions. The knobs of the pull pins 2182 may be knurled to provide improved grip. The rotation of the side panels 2130 about the first and second axes 2152, 2162 enhances the conformance and fit of the side portions 2114, 2116 to the patient when the side portions 2114, 2116 are contacting the patient lying on the deck 236 as shown in FIG. 12.

Figure 16:
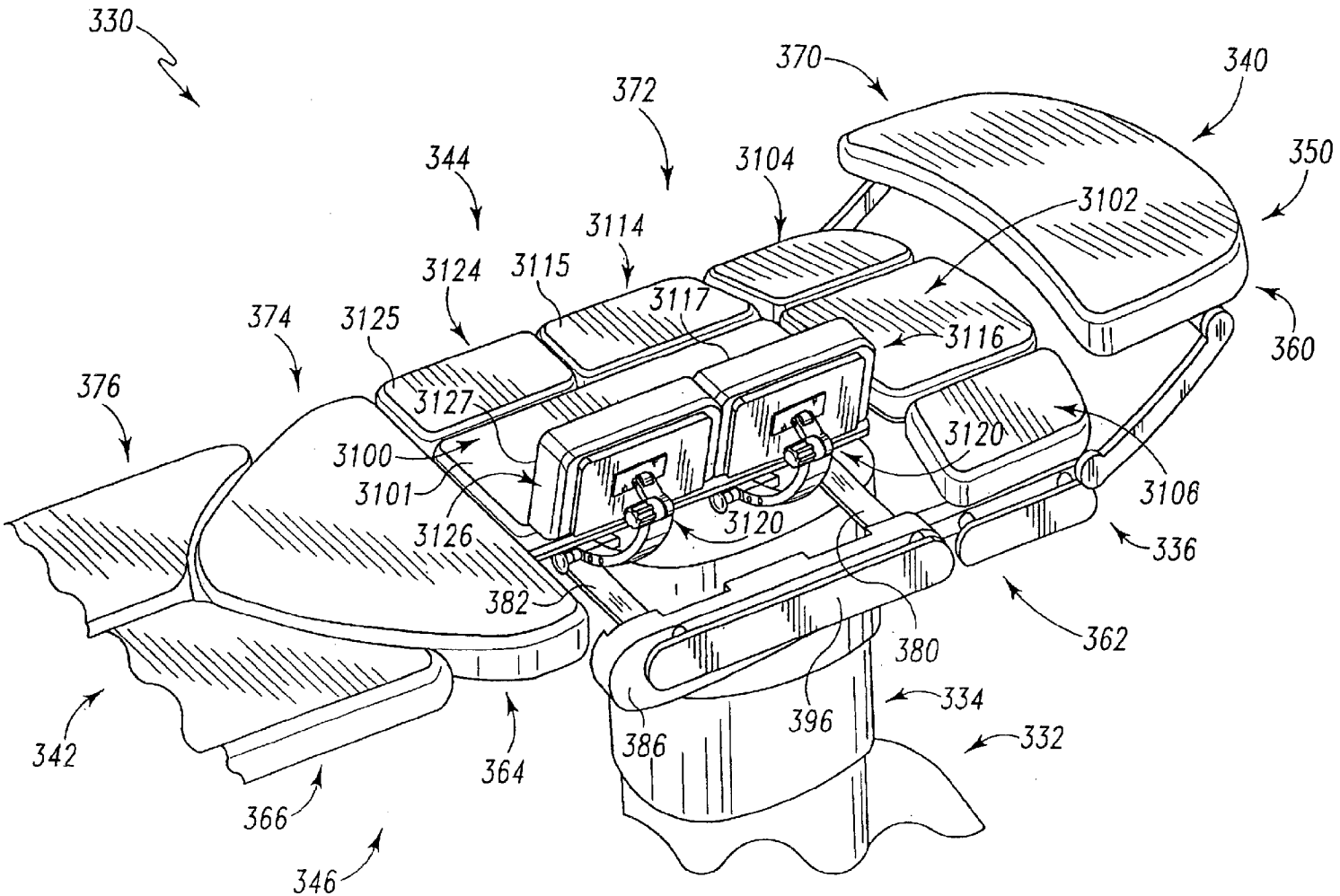
FIG. 16 is a partial perspective view similar to FIG. 11 of yet another embodiment of the illustrative surgical table, and showing a first pair of side portions coupled to a first side of the central portion and a second pair of side portions coupled to a second side of the central portion, the first pair of side portions being shown in the first coplanar position, and the second pair of side portions being pivoted upwardly to the second raised position.

Referring to FIG. 16, another embodiment 330 of the present invention is shown in which like elements generally bear the same reference numerals as in the two embodiments shown in FIGS. 1–9 and 10–15 respectively, except that they are preceded by a numeral "3". Thus, the surgical table 330 includes a base 332, a pedestal 334, a deck 336 and a mattress 350. The deck 336 includes a head section 360, a back section 362, a seat section 364, a thigh section 366 and a leg section 368. The mattress 350 includes a head section 370, a back section 372, a seat section 374, a thigh section 376 and a leg section 378. The deck 336 includes a pair of longitudinally-spaced transversely-extending cross members 380, 382 underlying the back section 362 and a pair of laterally-spaced longitudinally-extending frame members 384, 386 attached to the opposite sides 344, 346 of the cross members 380, 382. A pair of accessory rails 394, 396 are attached to the respective frame members 384, 386.

The back section 362 includes a central portion 3100, an upper back support portion 3102, a pair of shoulder pads 3104, 3106, a first pair of side portions 3114, 3124 coupled to the first side 344 of the central portion 3100 and a second pair of side portions 3116, 3126 coupled to the second side 344 of the central portion 3100. Each side portion 3114, 3124, 3116, 3126 is movably coupled to the central portion 3100 by a coupler 3120, which is similar to the couplers 2124, 2126 shown in FIGS. 13–15. Each side portion 3114, 3124, 3116, 3126 is configured to move between a first position and a second position. In the first position, the upper surfaces 3115, 3125, 3117, 3127 of the side portions 3114, 3124, 3116, 3126 are substantially coplanar with upper surface 3101 of the central portion 3100. In the second position, the side portions 3114, 3124, 3116, 3126 extend generally longitudinally and upwardly relative to the central section 3100, so that the upper surfaces 3115, 3125, 3117, 3127 of the side portions 3114, 3124, 3116, 3126 face laterally inwardly toward a patient lying on the deck 336.

Figure 17:
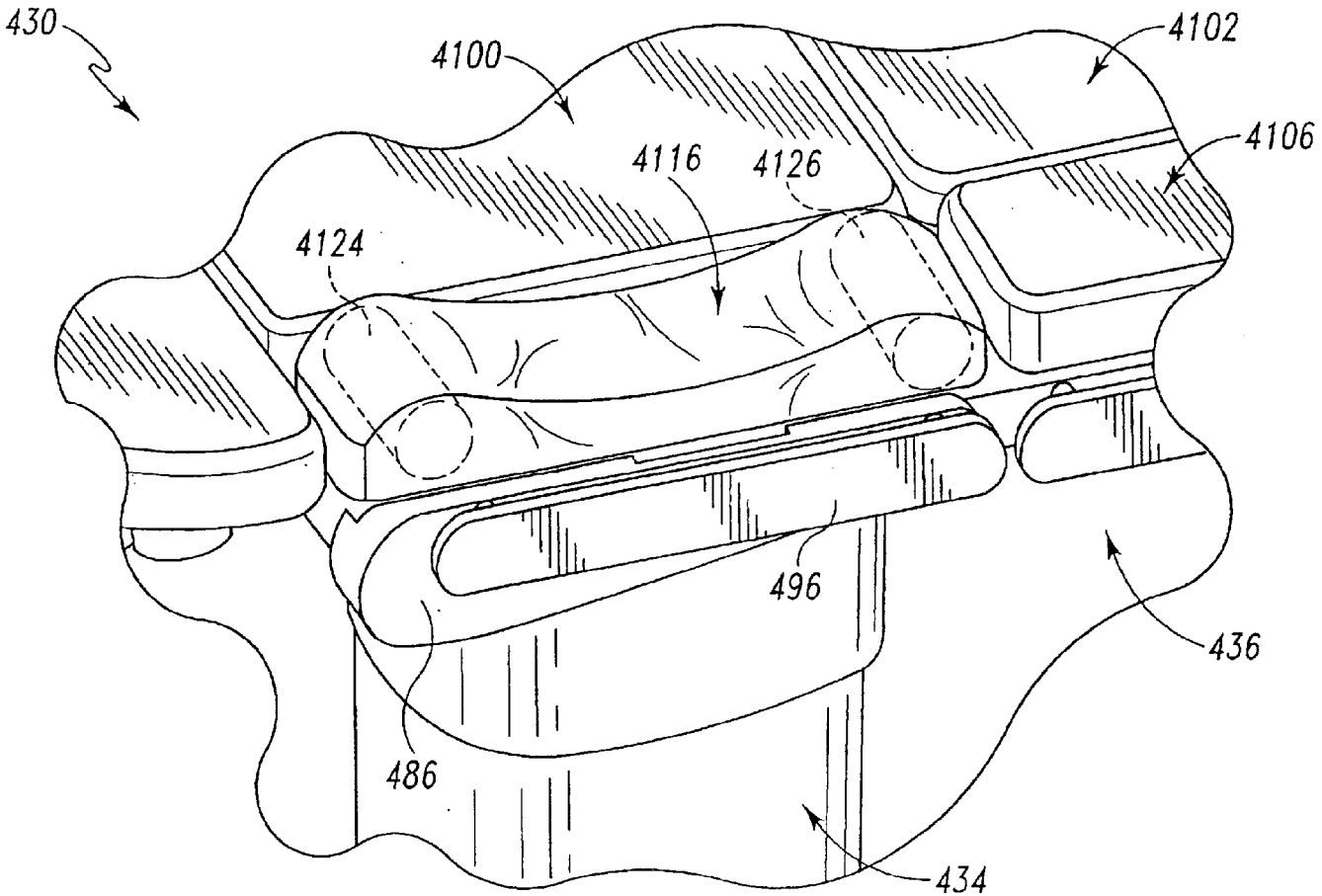
FIG. 17 is a partial perspective view of still another embodiment of the illustrative surgical table, and showing an extended-length contoured side portion including two air bladders to enhance the comfort and fit of the side portion to the patient resting on the deck when the side portion is in the second raised position and contacting the patient.
Figure 18:
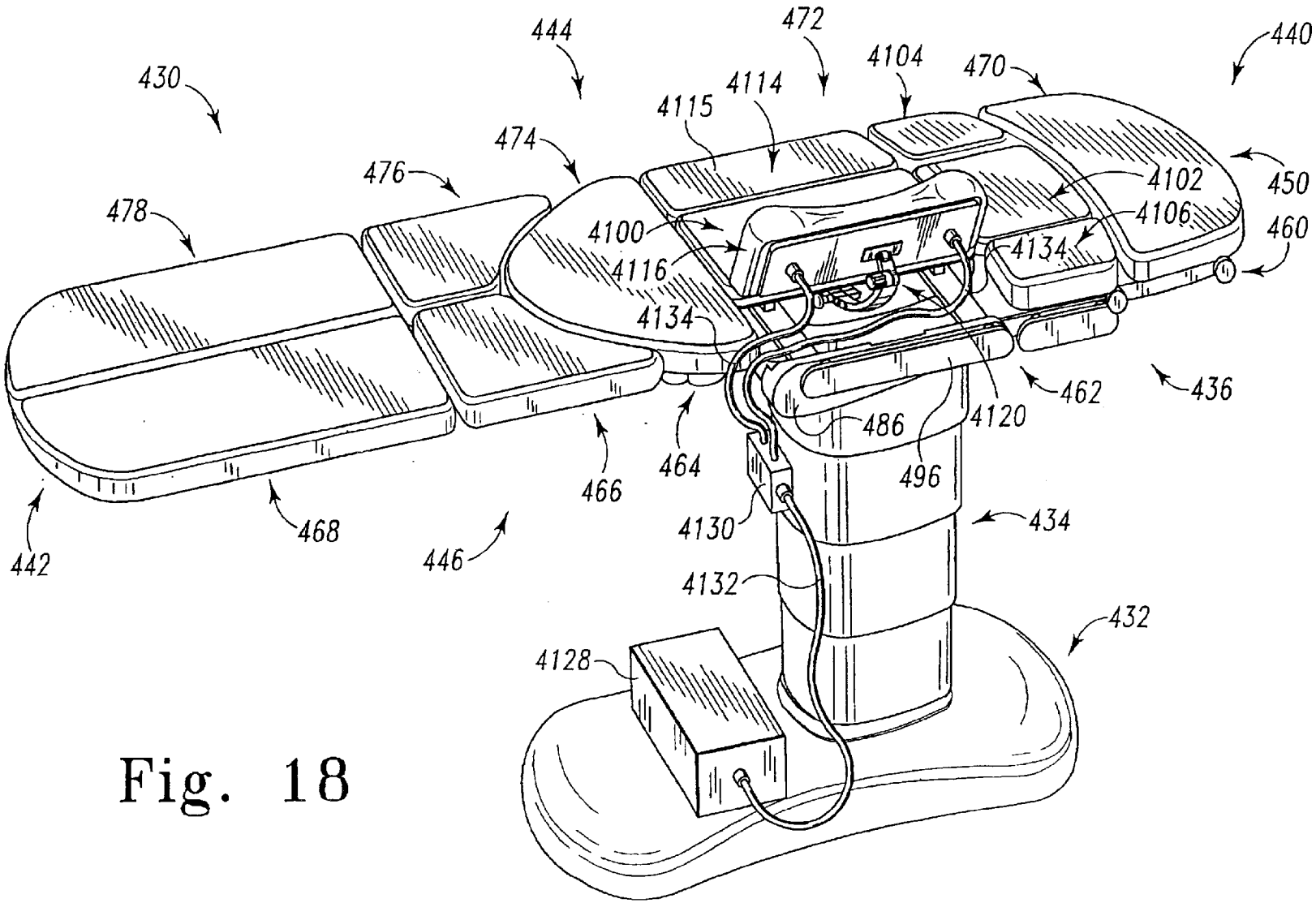
FIG. 18 is a perspective view of the FIG. 17 surgical table, and showing an air unit coupled pneumatically to the two air bladders in the contoured side portion, the air unit being configured to inflate the air bladders.

FIGS. 17 and 18 show another embodiment 430 of the illustrative surgical table. The surgical table 430 includes a first extended-length contoured side portion 4114 coupled to a first side 444 of the central portion 4100, and a second extended-length contoured side portion 4116 coupled to a second side 446 of the central portion 4100. Each side portion 4114, 4116 includes two air bladders 4124, 4126 to enhance the comfort and fit of the side portions 4114, 4116 to the patient resting on the deck 436 when the side portions 4114, 4116 are in a raised position and contacting the patient. As shown in FIG. 18, the surgical table 430 includes an air unit 4128, a manifold block 4130, an air tube 4132 coupling the air unit 4128 to the manifold block 4130, and a pair of air tubes 4134 coupling the manifold block 4130 to the to the air bladders 4124, 4126. Inflation of the air bladders 4124, 4126 gives the side portions 4114, 4116 the desired contoured shape.

A valve (obscured view) situated in the manifold block 4130 is positionable so that one or the other of the air bladders 4124, 4126 is inflated or so that both of the air bladders 4124, 4126 are inflated simultaneously. The valve is also movable to a position allowing the air bladders 4124, 4126 to be deflated. A user input on the manifold block 4130 or the surgical table 430 or on a pendant controller of the surgical table 430 is engaged to control the position of the valve situated in the manifold block 4130.

Figure 19:
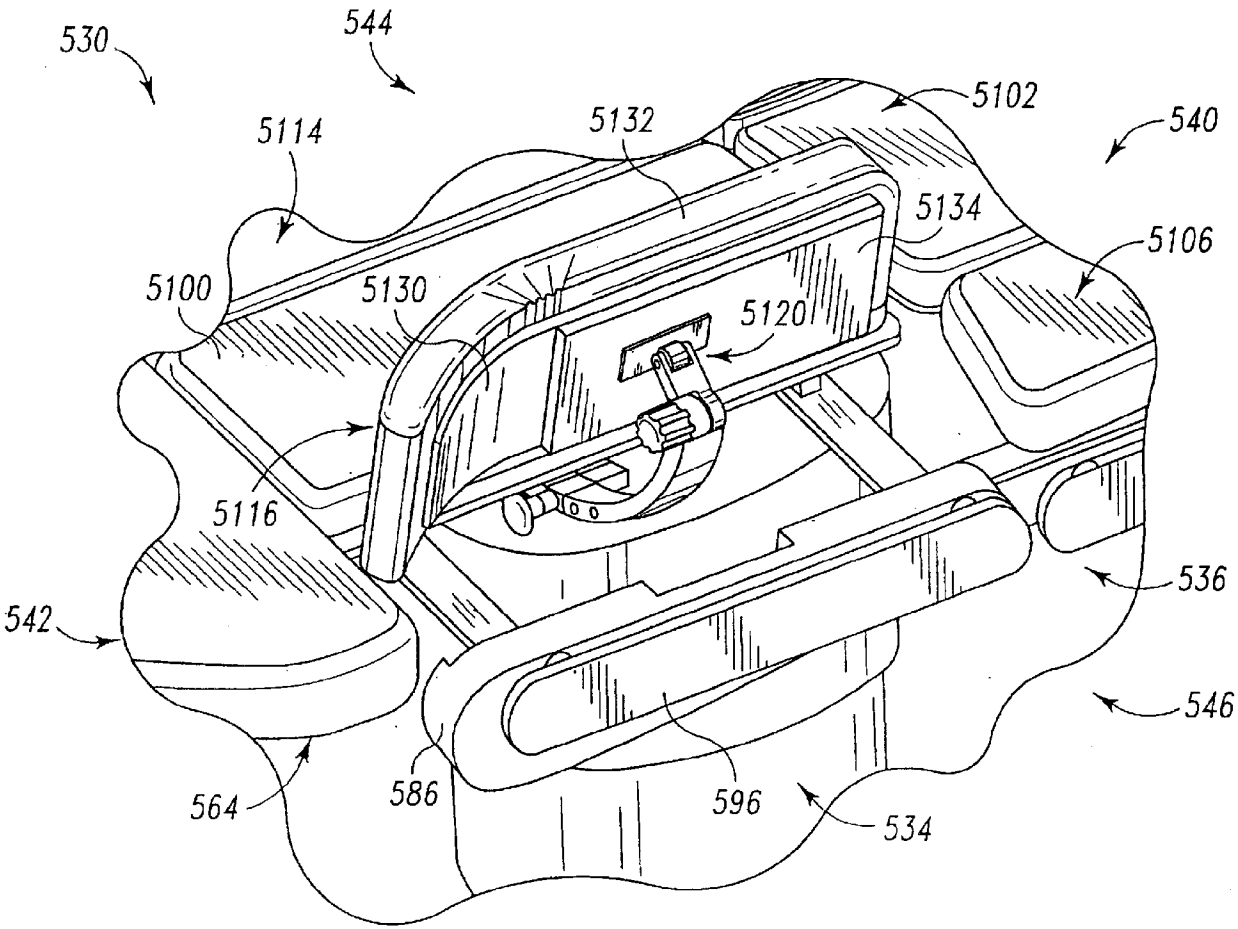
FIG. 19 is a partial perspective view similar to FIG. 18 of another embodiment of the illustrative surgical table, and showing an extended-length contoured side portion including a mattress pad coupled to a flexible panel that flexes to enhance the comfort and fit of the side portion to the patient supported on the deck when the side portion is in the second raised position and contacting the patient.
Figure 20:
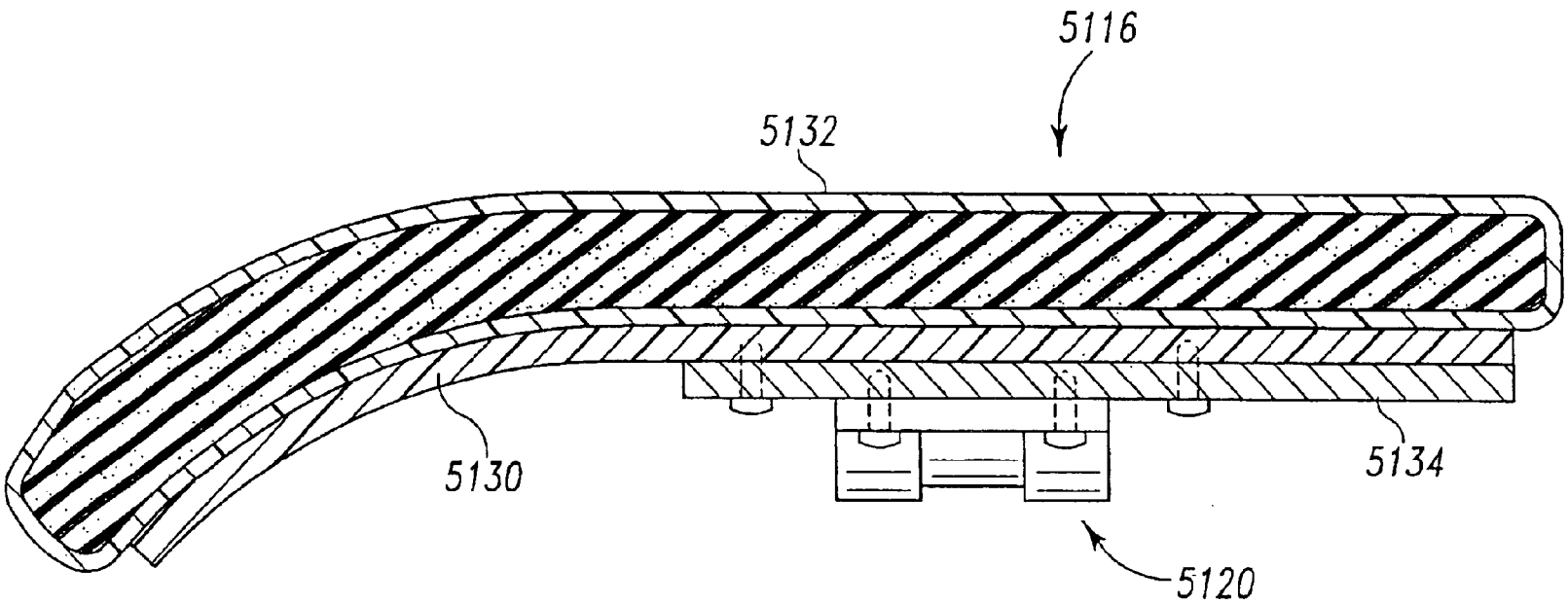
FIG. 20 is a cross sectional view of the FIG. 19 contoured side portion, and showing the mattress pad and the flexible panel.

FIGS. 19 and 20 show still another embodiment 530 of the illustrative surgical table. The surgical table 530 includes a first extended-length contoured side portion 5114 coupled to a first side 544 of the central portion 5100, and a second extended-length contoured side portion 5116 coupled to a second side 546 of the central portion 5100. Each side portion 5116 includes a flexible panel 5130 and a mattress pad 5132 coupled to the flexible panel 5132. As shown in FIG. 20, the flexible panel 5132 is, in turn, attached to a rigid plate 5134 which is coupled to the central portion 5100 by a coupler 5120. A portion of the flexible panel 5130 extends beyond the rigid plate 5134, and is configured to flex to enhance the comfort and fit of the side portions 5116 to the patient supported on the deck 536 when the side portions 5116 are in the second raised position and contacting the patient.

Although the present invention has been described in detail with reference to certain preferred embodiments, variations and modifications exist within the scope and spirit of the present invention as described above.

What is claimed is:

1. A surgical table comprising:

a base, and a patient support deck coupled to the base and including:

a. a first portion including a first panel and a first mattress pad supported by the first panel, b. at least one side portion including a second panel and a second mattress pad supported by the second panel, wherein the at least one side portion is movable between a first position in which the at least one side portion is able to support a portion of a patient thereabove and a second position situated alongside the patient to inhibit lateral movement of the patient lying on the patient support deck, and c. a frame member, the second panel of the at least one side portion being supported by the frame member and the first panel when the at least one side portion is in the first position, and the second panel of the at least one side portion being spaced from the frame member and first panel when the at least one side portion is in the second position.

2. The surgical table of claim 1, wherein the at least one side portion includes a first side portion movable relative to the first portion on a first side thereof and a second side portion movable relative to the first portion on a second side thereof.

3. The surgical table of claim 2, wherein the patient support deck includes at least a back section and a seat section, and wherein the first and second portions are part of the back section.

4. The surgical table of claim 1, further comprising a couple for coupling the at least one side portion to the first portion.

5. The surgical table of claim 1, wherein the first and second mattress pads are releasably coupled to the associated first and second panels.

6. The surgical table of claim 5, wherein the first and second mattress pads are releasably coupled to the associated first and second panels by hook-and-loop type fasteners so that the first and second mattress pads can be easily attached to or detached from the associated first and second panels.

7. The surgical table of claim 1, wherein the frame member extends longitudinally.

8. The surgical table of claim 1, wherein the at least one side portion includes a first pair of side portions movable relative to the first portion on a first side of the first portion and a second pair of side portions movable relative to the first portion on a second side of the first portion.

9. A surgical table comprising:

a base, and a patient support deck coupled to the base and including:

a. a first portion, b. at least one side portion movable relative to the first portion between a first position in which the at least one side portion is able to support a portion of a patient thereabove and a second position situated alongside the patient to inhibit lateral movement of the patient lying on the patient support deck, and c. a coupler for coupling the at least one side portion to the first portion, the coupler including:

a. a tube underlying the first portion, and b. an arm coupled to the at least one side portion and movable within the tube.

10. The surgical table of claim 9, wherein the arm is received in the tube when the at least one side portion is in the first position.

11. The surgical table of claim 9, wherein the at least one side portion comprises a side panel and a mattress pad coupled to the side panel, and wherein the arm is coupled to the side panel.

12. The surgical table of claim 9, wherein the tube is generally straight.

13. The surgical table of claim 12, wherein the patient support deck includes a frame member and part of the at least one side portion rests on the frame member when the at least one side portion is in the first position.

14. The surgical table of claim 13, wherein the tube has an end portion that extends outwardly from beneath the first portion and toward the frame member, and wherein the at least one side portion rests upon both the frame member and the end portion of the tube when the at least one side portion is in the first position.

15. The surgical table of claim 9, wherein the patient support deck includes a sub-panel below the first position, wherein the sub-panel includes at least one generally vertical-extending opening, and wherein the arm is configured to be slid out of the tube and inserted into the at least one generally vertically-extending opening in the sub-panel to support the at least one side portion in the second position.

16. The surgical table of claim 15, wherein the tube has a free end and the sub-panel includes a trough near the free end of the tube to facilitate extraction of the arm from the tube.

17. The surgical table of claim 15, wherein the at least one generally vertically-extending opening is located outside a footprint of the first portion.

18. The surgical table of claim 15, wherein the arm is pivotable relative to the sub-panel about a generally vertical axis when the at least one side portion is in the second position.

19. The surgical table of claim 15, wherein the sub-panel includes a plurality of generally vertically-extending openings, each of which is able to removably receive the arm.

20. The surgical table of claim 19, wherein each of the plurality of generally vertically-extending openings is located outside a footprint of the first portion.

21. The surgical table of claim 15, wherein the arm has a free end spaced apart from the at least one side portion, and wherein the at least one generally vertically-extending opening in the sub-panel has associated therewith a seat portion for supporting the free end of the arm when the at least one side portion is in the second position.

22. The surgical table of claim 15, wherein the at least one generally vertically-extending opening extends through the sub-panel, the arm has a free end spaced apart from the at least one side portion, and the free end of the arm has a seat portion configured to engage the sub-panel for supporting the arm when the at least one side portion is in the second position.

23. The surgical table of claim 9, wherein the coupler further includes a pivot joint configured to pivotally couple the at least one side portion to the arm for rotation about a generally horizontal pivot axis.

24. The surgical table of claim 23, wherein the pivot joint includes a bushing coupled to the underside of the at least one side portion and a pivot pin coupled to the arm and received in the bushing.

25. The surgical table of claim 9, wherein the side panel has a flexible portion that flexes to enhance conformance of the at least one side portion to the patient when the side portion is in the second position and contacting the patient lying on the patient support deck.

26. The surgical table of claim 9, wherein the first portion and the at least one side portion each include a panel and a mattress pad.

27. The surgical table of claim 9, further comprising an air unit, the at least one side portion including at least one air bladder, the air unit being pneumatically coupled to the at least one air bladder, and the air unit being operable to inflate the at least one air bladder.

28. A surgical table comprising:

a base, and a patient support deck coupled to the base and including:

a. a first portion, b. at least one side portion movable relative to the first portion between a first position in which the at least one side portion is able to support a portion of a patient thereabove and a second position situated alongside the patient to inhibit lateral movement of a patient lying on the patient support deck, and c. a coupler for coupling the at least one side portion to the first portion, the coupler including:

a. a tube underlying the first portion, and b. an arm assembly having a first arm coupled to the at least one side portion and a second arm coupled to the first arm and movable within the tube.

29. The surgical table of claim 28, wherein the at least one side portion includes a side panel and a mattress pad coupled to the side panel, and wherein the first arm is coupled to the side panel.

30. The surgical table of claim 29, wherein the side panel is pivotable relative to the first arm about a first pivot axis, and wherein the first arm is pivotable relative to the second arm about a second pivot axis.

31. The surgical table of claim 30, wherein the first pivot axis is substantially parallel with the second pivot axis.

32. The surgical table of claim 30, wherein the coupler further includes a first pivot joint configured to pivotally couple the side panel to the first arm for rotation about the first pivot axis.

33. The surgical table of claim 32, wherein the first pivot joint includes a bushing coupled to the underside of the side panel and a pivot pin coupled to the first arm and rotatably received in the bushing.

34. The surgical table of claim 30, wherein the coupler further includes a second pivot joint configured to pivotally couple the first arm to the second arm for rotation about the second pivot axis.

35. The surgical table of claim 34, wherein the second pivot joint includes a bushing coupled to the first arm, a bushing coupled to the second arm and a pivot pin extending through the bushings.

36. The surgical table of claim 34, wherein the second pivot joint includes a knob coupled to the arm assembly, wherein the knob is movable to a locking position preventing the first arm from pivoting relative to the second arm about the second pivot axis, and wherein the knob is movable to a releasing position permitting the first arm to pivot relative to the second arm about the second pivot axis.

37. The surgical table of claim 29, wherein the second arm extends from the first arm into the tube, and wherein the second arm is movable within the tube to move the at least one side portion between the first position and the second position.

38. The surgical table of claim 37, wherein the coupler further includes a knob, wherein the knob is movable to a locking position preventing the second arm from moving relative to the tube, and wherein the knob is movable to a releasing position permitting the second arm to move relative to the tube.

39. The surgical table of claim 37, wherein the tube and the second arm are both generally curved and transversely-extending.

40. The surgical table of claim 39, wherein the tube has a bore, wherein the second arm is received in the bore, and wherein the second arm and the bore both have a rectangular cross section.

41. The surgical table of claim 37, wherein the patient support deck has a frame member, wherein the first portion comprises a first panel and a first mattress pad coupled to the first panel, and wherein the side panel is supported by the frame member and the first panel when the at least one side portion is in the first position.

42. A patient support apparatus for supporting a patient, the patient support apparatus comprising:

a base, and a patient support deck supported above the base, the patient support deck having a first section underlying the patient and a side section, the side section being movable between a first position in which the side section is able to support a portion of the patient thereabove and a second position in which the the side section is situated alongside the patient to inhibit the patient from moving laterally outwardly off the first section, wherein the side section comprises a side panel, a mattress pad coupled to the side panel, and an arm assembly having a first arm coupled to the side panel and a second arm coupled to the first arm.

43. The patient support apparatus of claim 42, wherein the side panel is pivotable relative to the first arm about a first axis.

44. The patient support apparatus of claim 42, wherein the first axis is substantially horizontal.

45. The patient support apparatus of claim 42, wherein the side panel is pivotable relative to the first arm about a first pivot axis and the first arm is pivotable relative to the second arm about a second pivot axis.

46. The patient support apparatus of claim 45, wherein the first pivot axis is substantially parallel with the second pivot axis.

47. The patient support apparatus of claim 45, wherein the side section further comprises a knob coupled to the arm assembly, the knob is movable to a locking position preventing the first arm from pivoting relative to the second arm about the second pivot axis, and the knob is movable to a releasing position permitting the first arm to pivot relative to the second arm about the second pivot axis.

48. The patient support apparatus of claim 42, wherein the patient support deck has a tube underlying the first section, the second arm extends from the first arm into the tube, and the second arm is movable within the tube to move the side section between the first position and the second position.

49. The patient support apparatus of claim 48, wherein the patient support deck has a frame member, wherein the first section comprises a first panel and a mattress pad coupled to the first panel, and wherein the side panel is supported by the frame member and the first panel when the side section is in the first position.

50. The patient support apparatus of claim 42, wherein the side panel has a flexible portion that flexes to enhance conformance of the side section to the patient when the side section is in the second position and contacting the patient.

51. The patient support apparatus of claim 42, further comprising an air unit, the mattress pad comprising at least one air bladder, the air unit being coupled pneumatically to the at least one air bladder, and the air unit being operable to inflate the at least one air bladder.

52. A patient support apparatus for supporting a patient, the patient support apparatus comprising:

a base, and a patient support deck supported above the base, the patient support deck having a first section underlying the patient and a side section, the side section being movable between a first position in which the side section is able to support a portion of a patient thereabove and a second position situated alongside the patient to inhibit the patient from moving laterally outwardly off the first section, the side section comprising a side panel, a mattress pad coupled to the side panel, and an elongated member coupled to the side panel, the patient support deck having a tube underlying the first section, the elongated member having a free end spaced from the side panel, and the free end of the elongated member being configured to be received in the tube when the side section is in the first position.

53. The patient support apparatus of claim 52, wherein the patient support deck has a frame member, the tube has an end portion that extends outwardly from beneath the first section and toward the frame member, and the side panel rests upon both the frame member and the end portion of the tube when the side section is in the first position.

54. The patient support apparatus of claim 52, wherein the patient support deck has a sub-panel formed to include an opening, the elongated member has a free end spaced apart from the side panel, and the free end of the elongated member is received in the opening when the side section is in the second position.

55. A patient support apparatus comprising:

a base, and a patient support deck coupled to the base and including:

a. a first portion, b. at least one side portion, and c. a coupler coupled to the at least one side portion, the at least one side portion being movable between a first position in which the at least one side portion is able to support a portion of a patient thereabove and a second position in which the at least one side portion is situated alongside the patient to inhibit lateral movement of the patient lying on the patient support deck, wherein the coupler comprises a curved telescoping assembly.

* * * * *